United States Patent [19]

Olsson

[11] 4,089,389

[45] May 16, 1978

[54] SCAFFOLD

[76] Inventor: Lars-Uno Verner Olsson, Stenhogagatan 11, Oxie, Sweden, S523030

[21] Appl. No.: 669,536

[22] Filed: Mar. 23, 1976

[30] Foreign Application Priority Data

Apr. 17, 1975 Sweden ..... 7504441

[51] Int. Cl.[2] ..... E04G 1/08

[52] U.S. Cl. ..... 182/178; 182/119; 182/179

[58] Field of Search ..... 182/178, 179, 152, 119, 182/118; 52/637, 638; 211/148, 177; 403/263, 244, 230, 194, 197, 347

[56] References Cited

U.S. PATENT DOCUMENTS

| | | | |
|---|---|---|---|
| 666,947 | 1/1901 | Ward | 403/347 |
| 2,301,306 | 11/1942 | McDonald | 182/179 |
| 2,739,847 | 3/1956 | Webb | 182/179 |
| 3,033,310 | 5/1962 | McLeod | 182/228 |
| 3,468,430 | 9/1969 | Lawman | 211/191 |

FOREIGN PATENT DOCUMENTS

| | | | |
|---|---|---|---|
| 585,272 | 11/1958 | Italy | 182/179 |
| 11,700 of | 1914 | United Kingdom | 182/178 |

*Primary Examiner*—Reinaldo P. Machado
*Attorney, Agent, or Firm*—Jones, Tullar & Cooper

[57] ABSTRACT

The present invention relates to a scaffold consisting of section members, joining members, supporting shoulders and keys. The section members are provided with equidistantly spaced openings, the dimensions of which correspond to the outer dimensions of the section members. The scaffold is assembled by providing the section members, constituting the lower upright members, with support shoulders; threading section members on said upright members to rest against said support shoulders to constitute horizontal beams; by disposing a working platform on said beams; by threading guard railings through the openings of said upright members; by fixing said members and shoulders where necessary by means of keys; by joining further section members to the lower upright members by means of the joining members. The lastmentioned section members are provided with support shoulders and the above steps are repeated.

5 Claims, 8 Drawing Figures

SCAFFOLD

The present invention relates to a scaffold consisting of a small number of members and is thus advantageous from assembling and storing points of view.

There exist a great number of different kinds of scaffolds previously known. The members of these scaffolds are made from different materials, such as wood and metal. For the assembling of the scaffolds tools of different kinds as well as securing means, such as clamps etc., are required. Special attention must be paid to the stability and the strength of the lower portion of the scaffold and usually skilled workers are required at the assembling of the scaffolds. The risk of accidents is rather great due to the critical assembly work. Usually, these scaffolds are cumbrous and unwieldy.

The object of the present invention is to eliminate said disadvantages. Thus, the invention provides a scaffold comprising vertically joined upright members and horizontal beams supported by said upright members and working platforms in the nature of battens or the like intended to rest on said beams, wherein said upright members and said beam members consist of interchangeable hollow elongate section members having an essentially rectangular cross section; said section members being provided with equidistantly spaced openings in the wide sides, essentially along the whole length thereof; said openings having a size corresponding to the outer cross section of said section members; said section members being further provided with equidistantly spaced holes in the wide sides and in the narrow sides intended for receiving locking keys, said holes in the wide sides being positioned between said openings, and said holes in the narrow sides extending through said openings.

The object of the invention is achieved by providing a scaffold system consisting of section members. These section members are used substantially for every function and thus a high degree of flexibility is achieved. Furthermore, said section members are relatively short and light and are therefore easy to handle. The section members are provided with equidistant openings, the size of which substantially corresponds to the outer dimensions of the members, making them easier to handle. As will be shown below, no other tools than possibly a hammer and a set of keys of two or three different sizes are required for the assembly.

Figure 1:
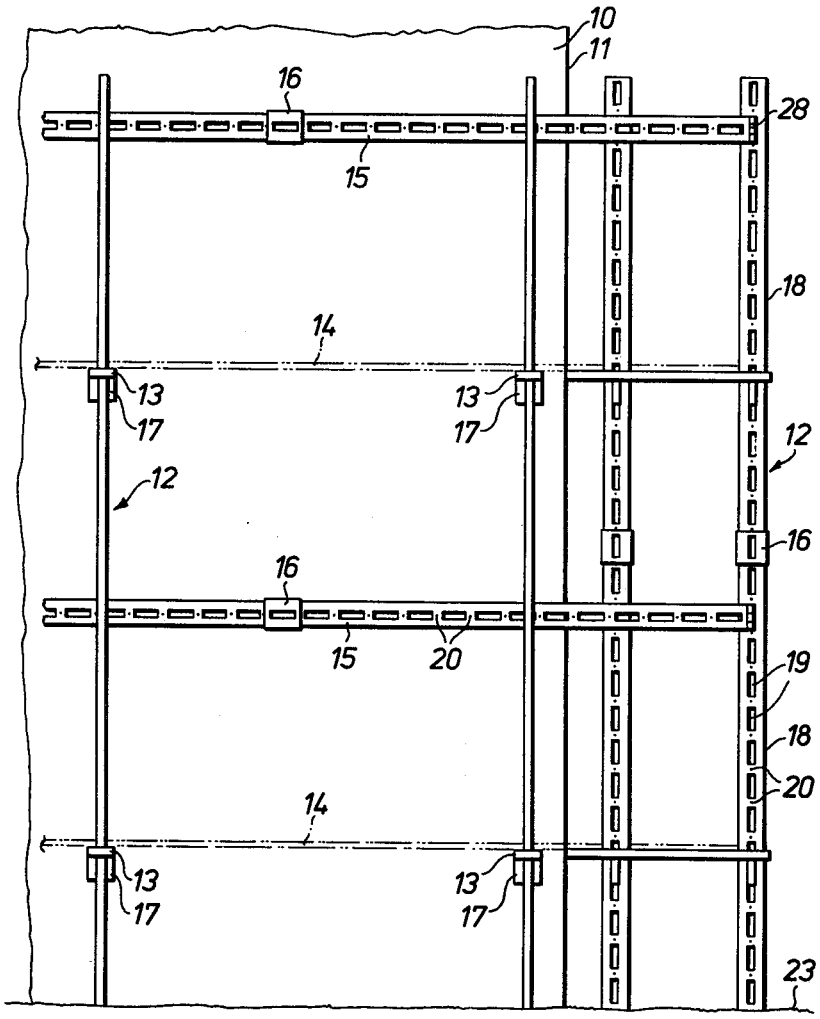
Figures 2, 4:
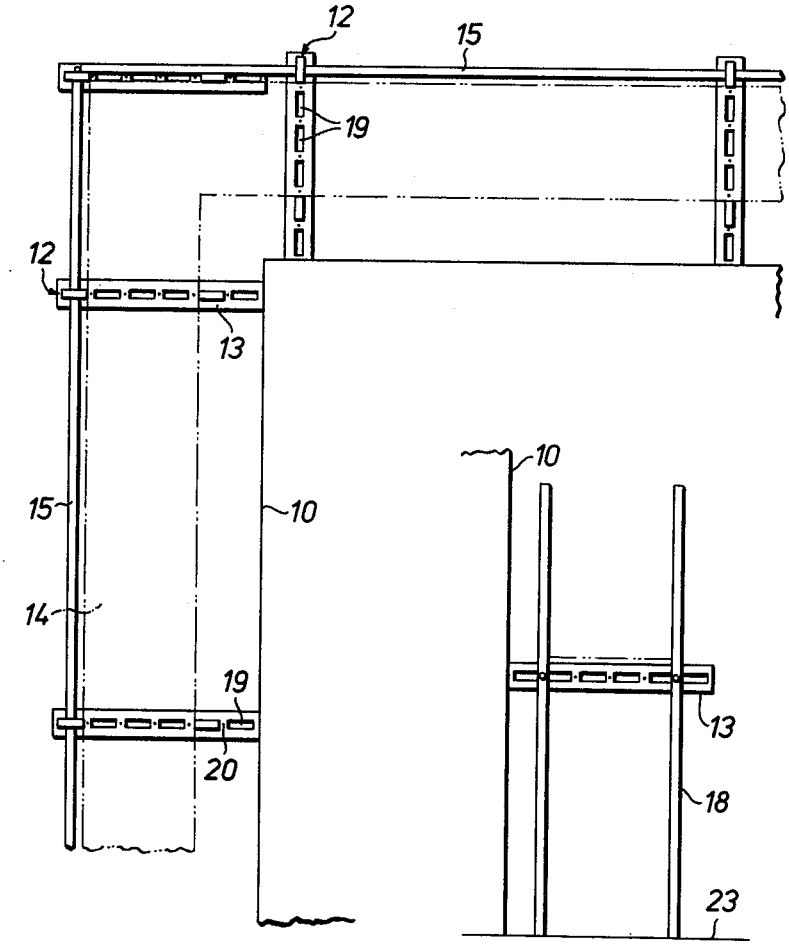
Figure 5:
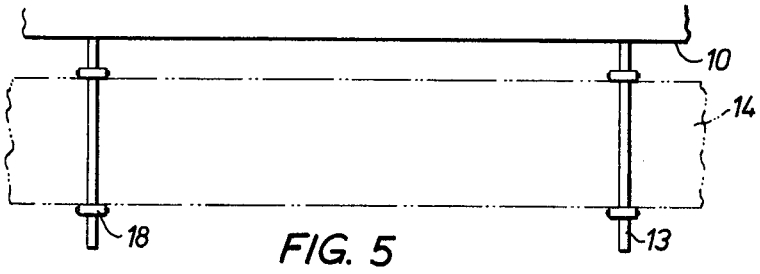
Figure 6:
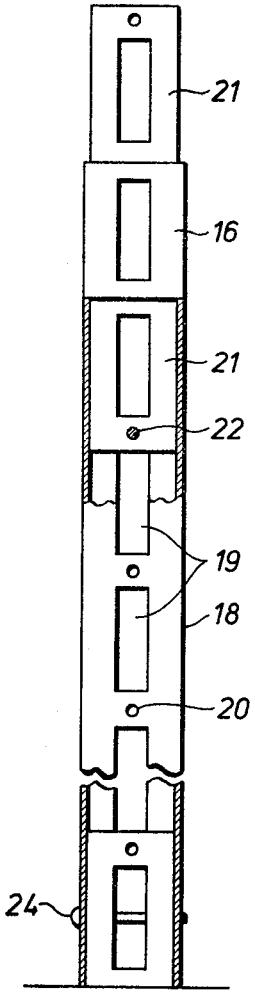
Figure 7:
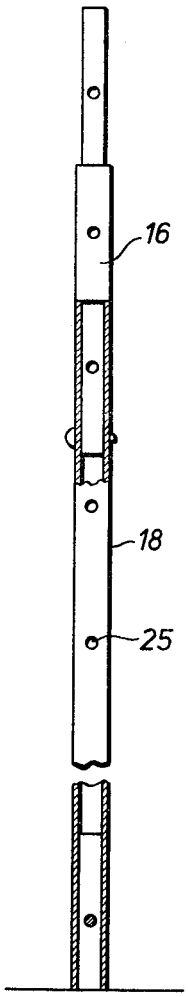

The invention will be described below with reference to the accompanying drawings, where FIG. 1 is a side view of an embodiment of a scaffold according to the invention and assembled around a corner, FIG. 2 is a plan view of the scaffold of FIG. 1, FIGS. 3–5 show a modified assembly of a scaffold having members according to the invention, and FIGS. 6 and 7 show section members and joining members for the section members.

Figure 8:
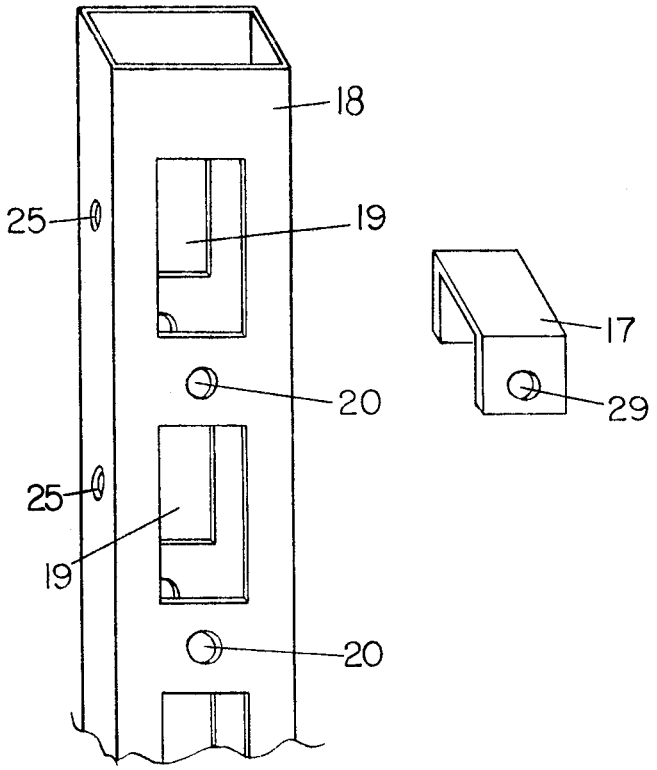

FIG. 8 shows a part of a section member and a supporting shoulder.

Figure 3:
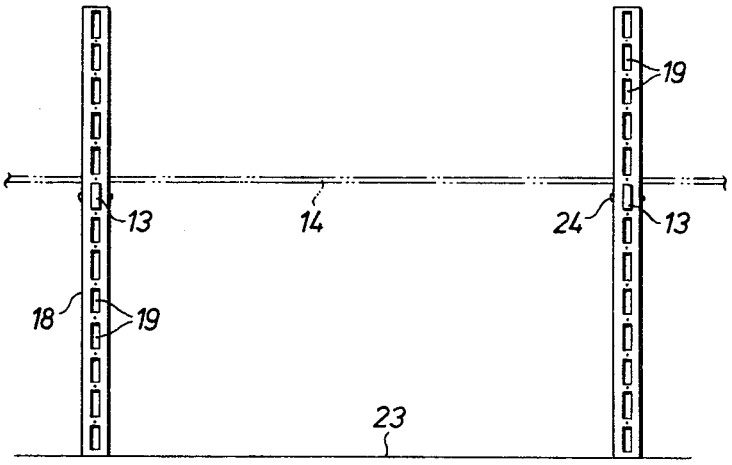

In FIG. 1 the reference numeral 10 is a working surface, e.g. a house wall. The wall 10 has a corner 11 and the scaffold extends around said corner. The scaffold is assembled from uprights 12, beams 13, working platforms 14 and guard railings 15. The joining, supporting and fastening members consist of joining members 16, supporting shoulders 17 and a number of keys 22, 24 (FIGS. 3 and 6).

The uprights 12 and the beams 13 consist of section members of a suitable length, e.g. 2 m. The beams 13 are preferably not joined but consist of continuous members. The members 18 from which the uprights 12 are assembled and the beam members 13 preferably consist of hollow metal box section girders, which are preferably treated to resist corrosion. The members may for example be made of a light metal, such as aluminum. The members having a rectangular cross section are provided with oppositely positioned openings 19 along the wide sides, the dimensions of said openings corresponding to the outer dimensions of the section members. The openings along the wide sides are equidistantly spaced. Between consecutive openings 19 there are holes 20 for receiving the locking keys.

The joining member 16 has projecting portions 21 with cross-sectional dimensions corresponding to the inner dimensions of the corresponding section members (see FIGS. 6 and 7). These portions 21 are inserted into the section members and are locked with keys 22 through the holes 20. The central portion of the joining member 16 has an outer cross section corresponding to the outer cross section of the section members.

The beams 13 are supported by supporting members or supporting shoulders 17, each of which is preferably U-shaped and dimensioned to be inserted in the openings 19 in opposed sides in order to rest against the lower portion of said opening such that the right angle legs of the supporting shoulder face downward on the exterior of the support beam 18. The supporting shoulder 17 as shown in FIG. 8 consists of a flat rectangular bar having right angle rectangular legs containing a hole 29 in each leg. A locking key is inserted through a hole 29 in the supporting shoulder and through a hole 20. The beams 13 having the same structure as the upright members 18 are threaded onto the upright members through the openings 19 in the beams and into abutting relation against the support shoulders 17.

The scaffold structure also includes guard railings 15 consisting of section members similar to the upright members 12 and the beam members 13. The guard railings are threaded through the openings of the uprights in order to be supported by the latter. The same kind of joining members 16 are used for the guard railing as for the uprights. Joining members provided with hinges 28 are preferably used at the corners of the guard railings.

In FIG. 1, the scaffold rests directly on the ground 23, but of course it is also possible to apply wheels to the lower portion of the scaffold. Such wheels can be applied to joining members of the same kind as the members 16.

The scaffold is assembled in the following manner. The lower upright members 18, shown in FIG. 1, are provided with support shoulders 17, whereupon beams are threaded on the upright members. Between adjacent pairs of upright members provided with beams a working platform 14 is disposed which consists for instance of a number of battens, whereupon the guard railings 15 are applied in order to make the structure rigid. In this case it may be suitable to apply locking keys through the holes 25 in the narrow sides of the upright members and through the holes 20 of the guard railings. When a suitable length of said lower working platform has been obtained, the upright members are vertically joined by applying joining members 16 to said lower upright members, whereupon the next upright member is applied to the first. Support shoulders are then introduced into suitable openings 19 in the upright members and the beams 13 are applied whereupon a new working platform 14 and a guard railing structure are built. In this manner, the assembling may continue to the intended height. The scaffolds are preferably assembled simultaneously along the first side 10 of the wall and along the wall at the other side of the corner.

In FIGS. 3–5 an alternative assembly of the scaffold is shown where section members according to the invention are involved. This scaffold is intended for wider working platforms 14 and the beams 13 are therefore upended. The structure of the beams is the same as in the previous embodiment. Due to the fact that the openings 19 of the upright members correspond to the outer cross section of the section members, the beams may be inserted directly into said openings. The beams are fixed by means of keys 24 introduced through holes 25 (FIG. 7) in the upright members and the holes 20 in the beams. The assembly of this alternative scaffold is similar to the assembly of the scaffold according to FIGS. 1 and 2. However, no supporting shoulders are used and the beams are not threaded on the upright members.

Of course, the structure of the scaffold according to the invention is not limited to the embodiments described above, but these embodiments may be combined in a suitable manner. Other structures are also possible. The main feature of the scaffold according to the invention is the flexibility. The scaffold can be adapted to most fields where scaffolds are used.

The scaffold can easily be built as a hanging scaffold for use in boat building or as a supporting scaffold in bridge building, where the mould of the bridge can be supported by the upper portion of the upright members. As mentioned above, the scaffold can be used as a wheel scaffold for successive advancement along a house wall. A person skilled in the art will realize further possibilities of modification within the scope of the appended claims.

What I claim is:

1. A scaffold comprising vertically joined upright members and horizontal beams supported by said upright members and working platforms in the nature of battens or the like intended to rest on said beams, wherein said upright members and said beams members consist of interchangeable hollow elongate section members each having an identical essentially rectangular cross section, each one of said upright members and said beam members being capable of being used either as an upright member or as a beam member; said section members being provided with equidistantly spaced openings in the wide sides, essentially along the whole length thereof; said openings having a size corresponding to the outer cross section of said section members; said section members being further provided with equidistantly spaced holes in the wide sides and in the narrow sides intended for receiving locking keys, said holes in the wide sides being positioned between said openings, and said holes in the narrow sides extending through said openings.

2. A scaffold as claimed in claim 1 wherein said beam members being threaded onto the upright members through the openings of the beam members; and said beam members being supported by supporting shoulders inserted into the openings of the upright members.

3. A scaffold as claimed in claim 2, wherein said supporting shoulders consist of essentially U-shaped members having an outer dimension corresponding to the width of the openings, and wherein the distance between the legs of said members is essentially equal to the thickness of said upright members and said supporting shoulders being fixed by means of keys inserted through holes in the legs and through the holes in the wide sides of the upright members.

4. A scaffold as claimed in claim 1, including joining members for vertical joining of the upright members;

said joining members having an intermediate portion of essentially the same dimensions as the section members and provided with openings, and having outer portions projecting from the two ends of the intermediate portion, said outer portions having cross sections corresponding to the inner cross sections of the section members and having openings and holes adapted to coincide with the openings and the holes of the upright member at the assembled position of the joining member.

5. A scaffold as claimed in claim 1, wherein said beam members are inserted through the openings at the wide sides of the upright members; and said keys are adapted to fix the beam members and are inserted through the holes at the narrow sides of the upright members and through the holes arranged between the openings of the beam members.

* * * * *